US005704778A

United States Patent [19]

Hsieh

[11] Patent Number: 5,704,778

[45] Date of Patent: Jan. 6, 1998

[54] GAS BURNER

[75] Inventor: Mei-Chang Hsieh, Taichung Hsien, Taiwan

[73] Assignee: Tri Square Industrial Co., Ltd., Taichung Hsien, Taiwan

[21] Appl. No.: 808,039

[22] Filed: Mar. 3, 1997

[51] Int. Cl.[6] ..... F23D 14/62

[52] U.S. Cl. ..... 431/354; 431/278; 431/284; 126/39 R; 239/561

[58] Field of Search ..... 431/284, 281, 431/354, 278, 355, 285, 198, 200, 264, 196; 126/39 R, 39 BA, 39 N, 39 E, 39 K, 39 J; 239/561, 560, 568, 567, 556

[56] References Cited

U.S. PATENT DOCUMENTS

| | | | |
|---|---|---|---|
| 2,037,400 | 4/1936 | Tschierschwitz | 126/39 R |
| 3,606,612 | 9/1971 | Reid, Jr. | 431/281 |
| 3,982,523 | 9/1976 | Love et al. | 126/39 R |
| 4,968,246 | 11/1990 | Sasada et al. | 126/39 R |
| 5,046,477 | 9/1991 | Bennett et al. | 126/39 R |
| 5,197,872 | 3/1993 | Martinez | 431/284 |
| 5,277,576 | 1/1994 | Hartung et al. | 431/39 R |
| 5,342,192 | 8/1994 | Hirano | 431/284 |
| 5,401,164 | 3/1995 | Yen | 431/355 |

*Primary Examiner*—James C. Yeung
*Attorney, Agent, or Firm*—Christie, Parker & Hale, LLP

[57] ABSTRACT

A gas burner includes an L-shaped inner gas delivery pipe disposed between a burner base and an inner gas outlet member. The inner gas delivery pipe is provided with a first regulating tube for adjusting the length of a horizontal section of the inner gas delivery pipe. The gas burner further includes at least one L-shaped outer gas delivery pipe disposed between the burner base and an annular outer gas outlet member that is disposed around the inner gas outlet member. The outer gas delivery pipe is provided with a second regulating tube for adjusting the length of a horizontal section of the outer gas delivery pipe located on one side of the inner gas delivery pipe.

3 Claims, 4 Drawing Sheets

GAS BURNER

BACKGROUND OF THE INVENTION

1. Field of the Invention

The present invention relates to a gas burner, more particularly to a gas burner which is capable of mixing a sufficient amount of air with combustible gas so as to achieve an enhanced burning effect, which has a simplified structure, and which is easy to install.

2. Description of the Related Art

U.S. Pat. No. 5,401,164 discloses a conventional gas burner having length adjustable gas delivery pipes. The conventional gas burner includes an inner gas outlet member, an inner gas delivery pipe disposed under the inner gas outlet member, an annular outer gas outlet member, several outer gas delivery pipes disposed under the outer gas outlet member, and a head seat disposed under the inner and outer gas delivery pipes. The inner gas outlet member has a plurality of inner gas outlets formed therein. The inner gas delivery pipe has an inlet, an outlet communicated with the inner gas outlets, two interconnected tubular sections movable relative to each other so as to adjust the length of the inner gas delivery pipe, and a locking unit for releasably interlocking the tubular sections. The outer gas outlet member has a plurality of outer gas outlets formed therein. Each of the outer gas delivery pipes has an inlet, an outlet communicated with the outer gas outlets, two interconnected tubular sections movable relative to each other so as to adjust the length of the outer gas delivery pipe, and a locking unit for releasably interlocking the tubular sections of the outer gas delivery pipe. The head seat includes a first gas supply pipe accepting the combustible gas from a gas supply source, and a second gas supply pipe connected securely to the first gas supply pipe so as to accept the combustible gas from a gas supply source. Several first nozzles are mounted removably on the first gas supply pipe and are spaced apart from the inlets of the outer gas delivery pipes respectively so as to direct the combustible gas from the first gas supply pipe to the inlets of the outer gas delivery pipes. Each of the first nozzles is associated with a corresponding one of the outer gas delivery pipes to define a first air mixing space therebetween. A second nozzle is mounted removably on the second gas supply pipe and is spaced apart from the inlet of the inner gas delivery pipe so as to direct the combustible gas from the second gas supply pipe to the inlet of the inner gas delivery pipe. The second nozzle and the inner gas delivery pipe together define a second air mixing space therebetween. An air inlet unit is formed in the outer surface of the gas burner between the outer gas outlet member and the head seat and is communicated with the first and second air mixing spaces. The combustible gas coming from the first and second nozzles is mixed with air in the first and second air mixing spaces, and flows out of the inner and outer gas outlet members through the inner and outer gas delivery pipes.

The aforementioned gas burner is still not satisfactory in that it has a relatively complicated structure and is relatively difficult to install.

SUMMARY OF THE INVENTION

The main object of the present invention is to provide a gas burner which includes length-adjustable gas delivery pipes, which has a simplified structure and which is easy to install.

Accordingly, the gas burner of the present invention includes a burner base, an L-shaped inner gas delivery pipe, at least one L-shaped outer gas delivery pipe, a tubular inner support, an annular hollow outer support, an inner gas outlet member, and an annular outer gas outlet member. The burner base includes a base plate provided with a plurality of gas supply pipes and a plurality of nozzles installed on the gas supply pipes, respectively. The L-shaped inner gas delivery pipe includes a horizontal section fastened to the base plate and formed with an inlet end, and a vertical section extending upwardly from the horizontal section. The inner gas delivery pipe is provided with a first regulating tube coupled to the inlet end of the horizontal section of the inner gas delivery pipe. The first regulating tube has a first end extending into the horizontal section of the inner gas delivery pipe and a second end extending out of the horizontal section of the inner gas delivery pipe. The second end is spaced from and opposite to a respective one of the nozzles on the base plate. The first regulating tube is movable axially relative to the horizontal section of the inner gas delivery pipe so as to regulate distance between the respective one of the nozzles and the second end of the first regulating tube. The L-shaped outer gas delivery pipe includes a horizontal section fastened to the base plate on one side of the inner gas delivery pipe and formed with an inlet end, and a vertical section extending upwardly from the horizontal section of the outer gas delivery pipe. The outer gas delivery pipe is provided with a second regulating tube coupled to the inlet end of the horizontal section of the outer gas delivery pipe. The second regulating tube has a first end extending into the horizontal section of the outer gas delivery pipe and a second end extending out of the horizontal section of the outer gas delivery pipe. The second end of the second regulating tube is spaced from and opposite to a respective one of the nozzles on the base plate. The second regulating tube is movable axially relative to the horizontal section of the outer gas delivery pipe so as to regulate distance between the respective one of the nozzles and the second end of the second regulating tube. The tubular inner support has a bottom end connected to the vertical section of the inner gas delivery pipe, and is in fluid communication with the inner gas delivery pipe. The annular hollow outer support has a bottom end connected to the vertical section of each of the outer gas delivery pipes, and is in fluid communication with each of the outer gas delivery pipes. The inner gas outlet member is disposed on top of the inner support and is formed with a plurality of inner gas outlets in fluid communication with the inner support. The annular outer gas outlet member is disposed on top of the outer support around the inner gas outlet member and is formed with a plurality of outer gas outlets in fluid communication with the outer support.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
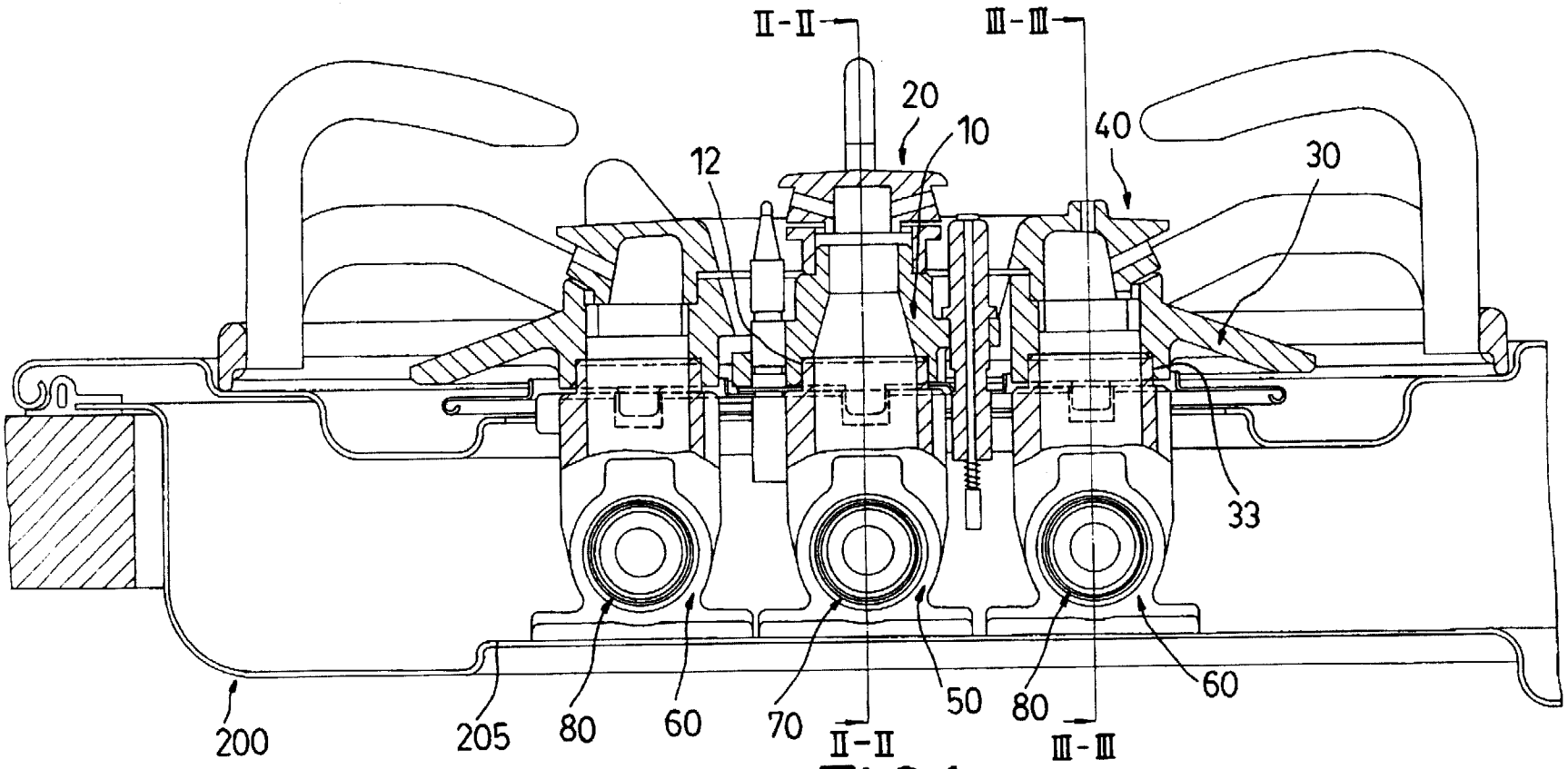
FIG. 1 is a front, vertical sectional view illustrating a gas burner according to a preferred embodiment of the present invention.
Figure 2:
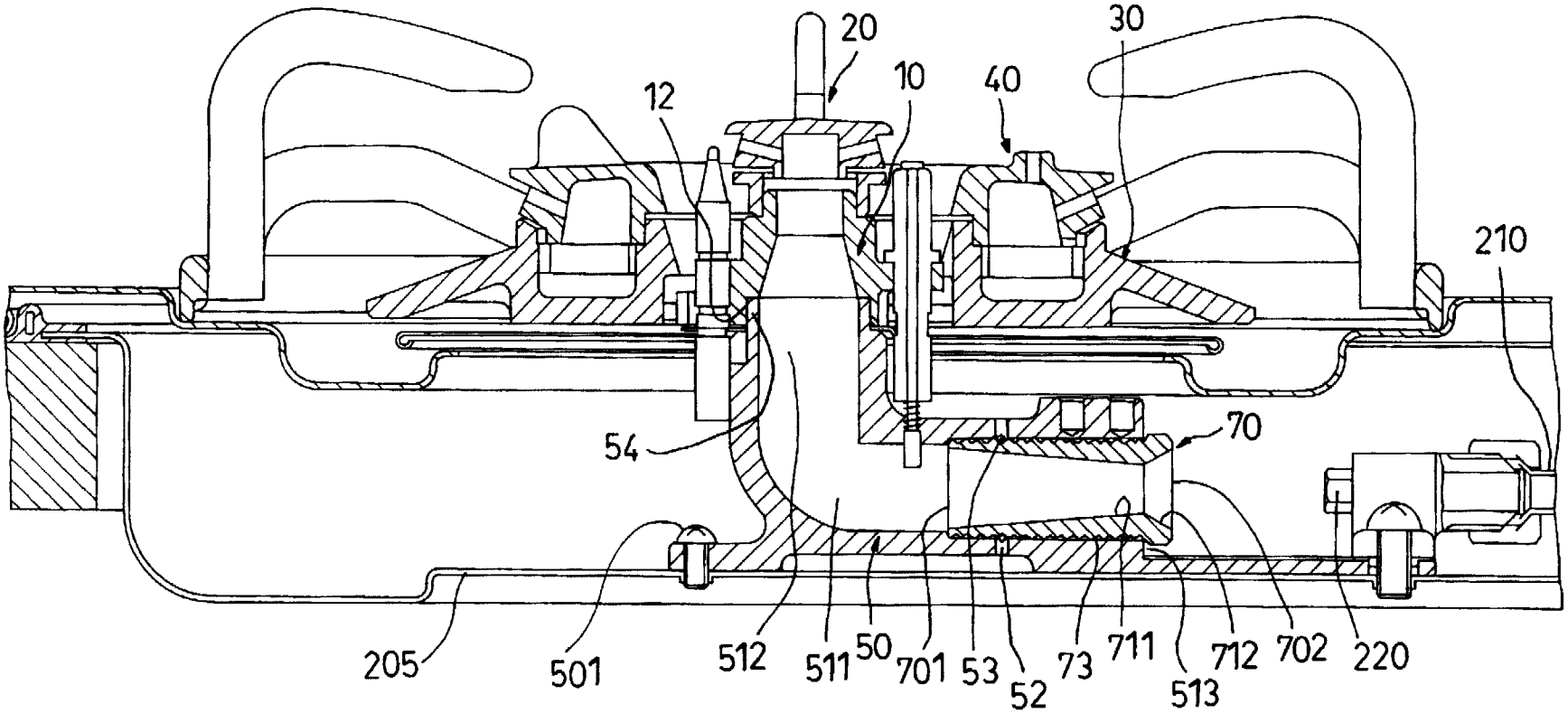
FIG. 2 is a side, vertical sectional view illustrating the gas burner taken from line II—II of FIG. 1.
Figure 3:
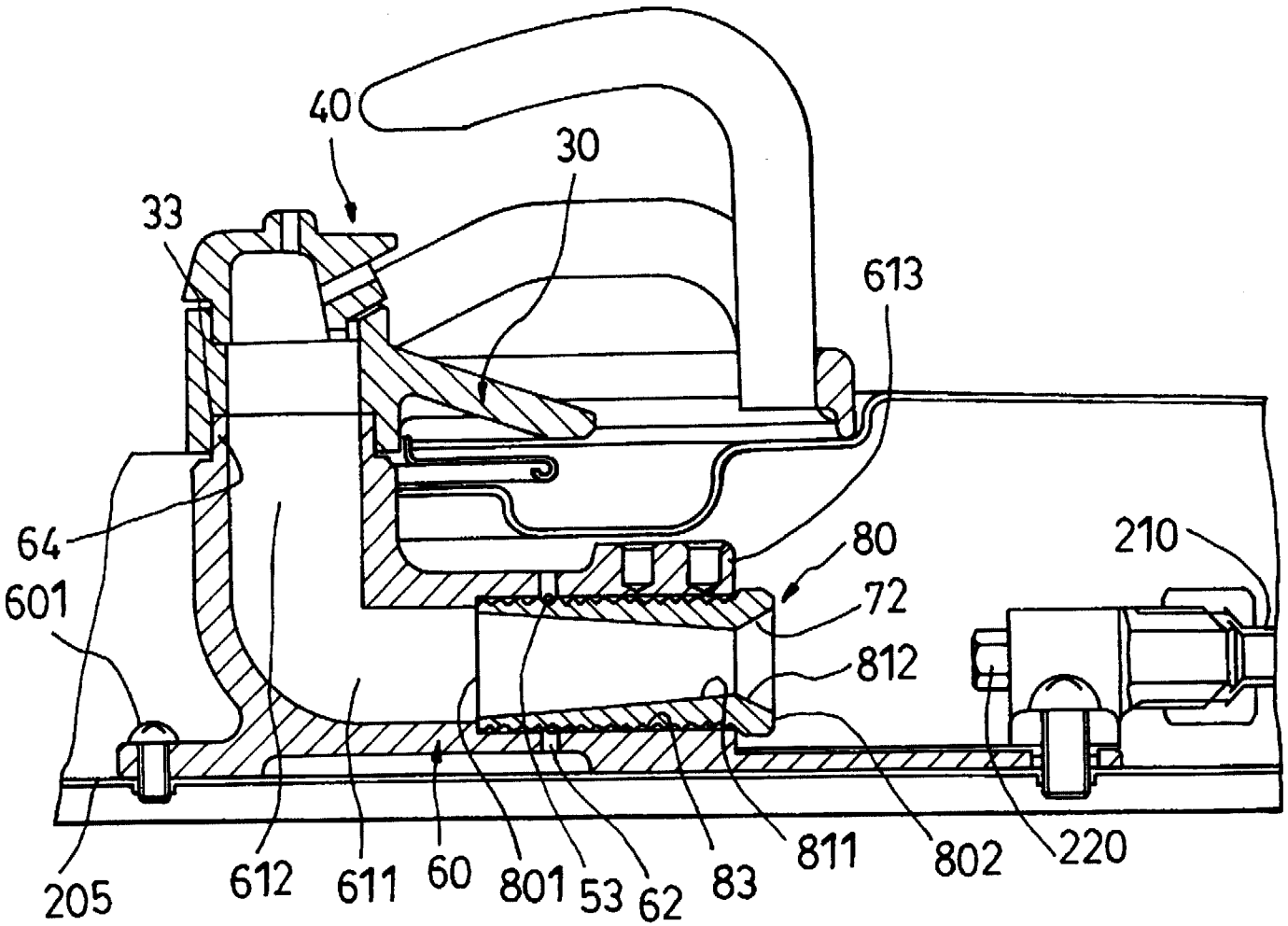
FIG. 3 is a side, vertical sectional view illustrating the gas burner taken from line III—III of FIG. 1.

Referring to FIGS. 1 to 3, the gas burner according to a preferred embodiment of the present invention includes a burner base 200, an L-shaped inner gas delivery pipe 50, two L-shaped outer gas delivery pipes 60, a tubular inner support 10, an annular hollow outer support 30, an inner gas outlet member 20, and an annular outer gas outlet member 40.

The burner base 200 includes a base plate 205 with a plurality of gas supply pipes 210 and a plurality of nozzles 220 installed on the gas supply pipes 210, respectively.

The L-shaped inner gas delivery pipe 50, as best illustrated in FIG. 2, includes a horizontal section 511 fastened to the base plate 205 by means of a bolt 501 and formed with an inlet end 513, and a vertical section 512 extending upwardly from the horizontal section 511. The horizontal section 511 is formed with a pair of diametrically opposite radial slots 52 therethrough. The inner gas delivery pipe 50 is provided with a first regulating tube 70 which is coupled to the inlet end 513 of the horizontal section 511 of the inner gas delivery pipe 50. The first regulating tube 70 has a first end 701 extending into the horizontal section 511 of the inner gas delivery pipe 50 and a second end 702 extending out of the horizontal section 511 of the inner gas delivery pipe 50. The second end 702 is spaced from and opposite to a respective one of the nozzles 220 on the base plate 205. The first regulating tube 70 is movable axially relative to the horizontal section 511 of the inner gas delivery pipe 50 so as to regulate the distance between the respective one of the nozzles 220 and the second end 702 of the first regulating tube 70. In this embodiment, the first regulating tube 70 has an outer surface formed with a series of annular peripheral engaging grooves 73 therearound. Preferably, the engaging grooves 73 are in the form of an external screw thread. The first regulating tube 70 confines a through hole having a longer first section 711 which diverges gradually in a direction away from the second end 702, and a shorter second section 712 which diverges gradually in a direction away from the first end 701. The second section 712 is capable of guiding entry of gas and air into the first regulating tube 70. Each of the L-shaped outer gas delivery pipes 60, as best illustrated in FIG. 3, includes a horizontal section 611 fastened to the base plate 205 by means of a bolt 601. The outer gas delivery pipes 60 are respectively located on two sides of the inner gas delivery pipe 50. The horizontal section 611 of each of the outer gas delivery pipes 60 is formed with an inlet end 613. A vertical section 612 extends upwardly from the horizontal section 611 of the outer gas delivery pipe 60. The horizontal section 611 of the outer gas delivery pipe 60 is formed with a pair of diametrically opposite radial slots 62 therethrough. The outer gas delivery pipe 60 is provided with a second regulating tube 80 which is coupled to the inlet end 613 of the horizontal section 611 of the outer gas delivery pipe 60. The second regulating tube 80 has a first end 801 extending into the horizontal section 611 of the outer gas delivery pipe 60 and a second end 802 extending out of the horizontal section 611 of the outer gas delivery pipe 60. The second end 802 is spaced from and opposite to a respective one of the nozzles 220 on the base plate 205. The second regulating tube 80 is movable axially relative to the horizontal section 611 of the outer gas delivery pipe 60 so as to regulate the distance between the respective one of the nozzles 220 and the second end 802 of the second regulating tube 80. The second regulating tube 80 also has an outer surface formed with a series of annular peripheral engaging grooves 83 therearound. Preferably, the engaging grooves 83 are in the form of an external screw thread. The second regulating tube 80 confines a through hole having a longer first section 811 which diverges gradually in a direction away from the second end 802, and a shorter second section 812 which diverges gradually in a direction away from the first end 801 so as to guide entry of gas and air into the second regulating tube 80.

Figure 4:
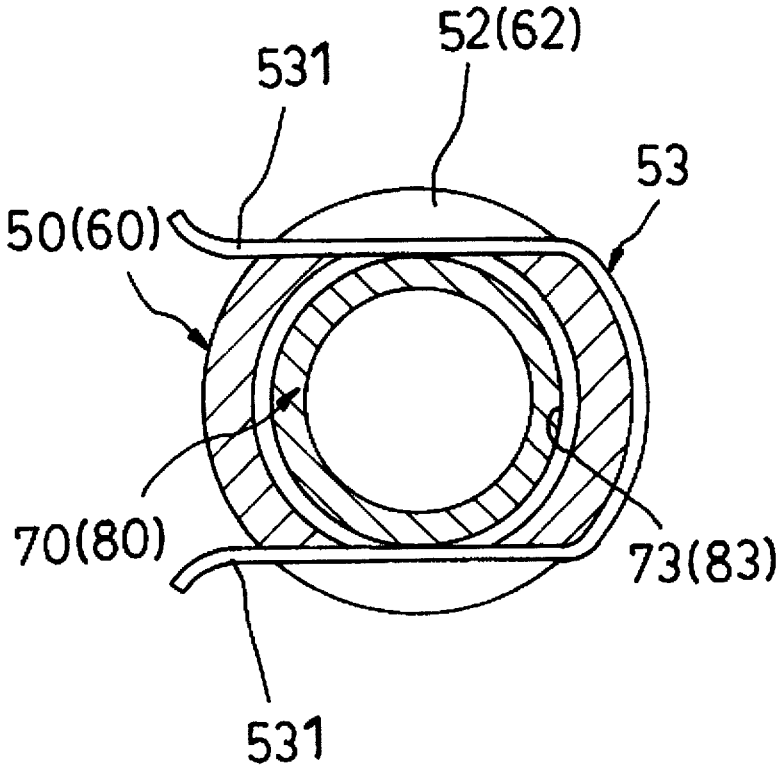
FIG. 4 is a vertical sectional view illustrating a retaining member for retaining a first (second) regulating tube of the gas burner.

The gas burner further includes three U-shaped retaining members 53, as best illustrated in FIG. 4, each of which has two parallel clamping parts 531 that are respectively and removably received in the radial slots 52 (62) in the horizontal section of a respective one of the inner and outer gas delivery pipes 50, 60. The clamping parts 531 engage one of the engaging grooves 73, 83 of a respective one of the first and second regulating tubes 70, 80 for releasably retaining the respective one of the first and second regulating tubes 70, 80 in the respective one of the inner and outer gas delivery pipes 50, 60.

Referring to once more to FIG. 2, the tubular inner support 10 has a bottom end 12 connected to a top end 54 of the vertical section 512 of the inner gas delivery pipe 50. The bottom end 12 of the inner support 10 is preferably sleeved on the top end 54 of the inner gas delivery pipe 50. As such, the tubular inner support 10 is in fluid communication with the inner gas delivery pipe 50.

The inner gas outlet member 20 is disposed on top of the inner support 10 and is formed with a plurality of inner gas outlets in fluid communication with the tubular inner support 10.

As shown in FIG. 3, the annular hollow outer support 30 has a bottom end 33 connected to a top end 64 of the vertical section 612 of each of the outer gas delivery pipes 60. The bottom end 33 of the outer support 30 is preferably sleeved on the top end 64 of the outer gas delivery pipes 60. Therefore, the hollow outer support 30 is in fluid communication with each of the outer gas delivery pipes 60.

The annular outer gas outlet member 40 is disposed on top of the outer support 30 around the inner gas outlet member 20 and is formed with a plurality of outer gas outlets in fluid communication with the outer support 30.

In use, when the gas burner is operated for burning, air flows into the space within the burner base 200 and mixes with the combustible gas coming from the nozzles 220. The mixed air and gas is guided through the first and second regulating tubes 70, 80 and into the inner and outer gas delivery pipes 50, 60. Since the air needed to mix with the combustible gas differs when different combustible gases are used, the distance between the nozzles 220 and the respective gas delivery pipes 50, 60 should be adjusted when the combustible gas is changed. In this situation, the retaining members 53 are removed from the first and second regulating tubes 70, 80, which are then moved inwardly or outwardly in the horizontal section 511, 611 of the respective gas delivery pipes 50, 60. When the regulating tubes 70, 80 are moved to desired positions, the clamping parts 531 of the retaining members 53 are received once again in the radial slots 52, 62 to engage another one of the engaging grooves 73, 83 so as to position the first and second regulating tubes 70, 80 in the respective gas delivery pipe 50, 60.

It is noted that the inner and outer gas delivery pipes 50, 60 can be formed to have similar structures, thereby resulting in convenience during the manufacturing thereof. Moreover, since the outer gas delivery pipes 60 are disposed on opposite sides of the inner gas delivery pipe 50, the nozzles 220 can thus be arranged so as to be aligned with one another. A simplified structure can be obtained. The gas burner of the present invention is thus easier to assemble and install.

With this invention thus explained, it is apparent that numerous modifications and variations can be made without departing from the scope and spirit of this invention. It is therefore intended that this invention be limited only as indicated in the appended claims.

I claim:

1. A gas burner comprising:

a burner base including a base plate provided with a plurality of gas supply pipes and a plurality of nozzles installed on said gas supply pipes, respectively;

an L-shaped inner gas delivery pipe including a horizontal section fastened to said base plate and formed with an inlet end, and a vertical section extending upwardly from said horizontal section, said inner gas delivery pipe being provided with a first regulating tube coupled to said inlet end of said horizontal section of said inner gas delivery pipe, said first regulating tube having a first end extending into said horizontal section of said inner gas delivery pipe and a second end extending out of said horizontal section of said inner gas delivery pipe, said second end being spaced from and opposite to a respective one of said nozzles on said base plate, said first regulating tube being movable axially relative to said horizontal section of said inner gas delivery pipe so as to regulate distance between the respective one of said nozzles and said second end of said first regulating tube;

at least one L-shaped outer gas delivery pipe including a horizontal section fastened to said base plate on one side of said inner gas delivery pipe and formed with an inlet end, and a vertical section extending upwardly from said horizontal section of said outer gas delivery pipe, said outer gas delivery pipe being provided with a second regulating tube coupled to said inlet end of said horizontal section of said outer gas delivery pipe, said second regulating tube having a first end extending into said horizontal section of said outer gas delivery pipe and a second end extending out of said horizontal section of said outer gas delivery pipe, said second end of said second regulating tube being spaced from and opposite to a respective one of said nozzles on said base plate, said second regulating tube being movable axially relative to said horizontal section of said outer gas delivery pipe so as to regulate distance between the respective one of said nozzles and said second end of said second regulating tube;

a tubular inner support having a bottom end connected to said vertical section of said inner gas delivery pipe, said tubular inner support being in fluid communication with said inner gas delivery pipe;

an annular hollow outer support having a bottom end connected to said vertical section of each of said outer gas delivery pipes, said hollow outer support being in fluid communication with each of said outer gas delivery pipes;

an inner gas outlet member disposed on top of said inner support and formed with a plurality of inner gas outlets in fluid communication with said inner support; and an annular outer gas outlet member disposed on top of said outer support around said inner gas outlet member and formed with a plurality of outer gas outlets in fluid communication with said outer support.

2. The gas burner according to claim 1, wherein said horizontal section of each of said inner and outer gas delivery pipes is formed with a pair of diametrically opposite radial slots therethrough, each of said first and second regulating tubes having an outer surface formed with a series of annular peripheral engaging grooves therearound, said gas burner further comprising a U-shaped retaining member which includes two parallel clamping parts that are respectively and removably received in said radial slots of said horizontal section of a respective one of said inner and outer gas delivery pipes and that engage one of said engaging grooves of a respective one of said first and second regulating tubes for releasably retaining the respective one of said first and second regulating tubes in the respective one of said inner and outer gas delivery pipes.

3. The gas burner according to claim 1, wherein said second end of each of said first and second regulating tubes confines a through hole that diverges gradually in a direction away from said first end to guide entry of gas and air into said first and second regulating tubes.

* * * * *